US009214744B2

(12) United States Patent
Takamura et al.

(10) Patent No.: US 9,214,744 B2
(45) Date of Patent: Dec. 15, 2015

(54) CONNECTOR DEVICE

(71) Applicant: Yazaki Corporation, Tokyo (JP)

(72) Inventors: Naoki Takamura, Makinohara (JP); Shinichi Ikemoto, Yokohama (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/017,595

(22) Filed: Sep. 4, 2013

(65) Prior Publication Data

US 2014/0065850 A1 Mar. 6, 2014

(30) Foreign Application Priority Data

Sep. 4, 2012 (JP) ..... 2012-194484

(51) Int. Cl.
*H01R 12/70* (2011.01)
*H01R 13/629* (2006.01)
*H01R 13/518* (2006.01)

(52) U.S. Cl.
CPC ..... *H01R 12/7011* (2013.01); *H01R 12/7023* (2013.01); *H01R 13/62994* (2013.01); *H01R 13/518* (2013.01)

(58) Field of Classification Search
CPC ..... H01R 12/7011; H01R 12/7023; H01R 13/518; H01R 13/62994; H01R 13/62955; H01R 13/62938; H01R 13/62966; H01R 13/62972
USPC ..... 439/65, 372, 157, 160, 310, 152, 153, 439/347, 342
See application file for complete search history.

(56) References Cited

U.S. PATENT DOCUMENTS 5,507,666 A * 4/1996 Yamanashi ..... 439/489
6,183,276 B1 * 2/2001 Tsuji et al. ..... 439/157
6,264,485 B1 7/2001 Saka et al.
6,315,585 B1 11/2001 Oka (Continued)

FOREIGN PATENT DOCUMENTS

JP 2001-43930 A 2/2001
JP 2001-118631 A 4/2001

(Continued)

OTHER PUBLICATIONS

Office Action dated Aug. 22, 2014 issued by the Korean Intellectual Property Office in counterpart Korean Patent Application No. 10-2013-0106061.

(Continued)

*Primary Examiner* — James Harvey
*Assistant Examiner* — Oscar C Jimenez
(74) *Attorney, Agent, or Firm* — Sughrue Mion, PLLC

(57) ABSTRACT

A connector device includes a plurality of board mounted connectors and mating side connectors to be fitted with each other and a guiding hood. Levers are rotatably attached to the mating side connectors. A guiding hood includes a plurality of connector fitting parts which guide an insertion of the mating side connectors corresponding to the board mounted connectors, and is attached to the opening part of the housing case. The board mounted connectors and the mating side connectors are configured to be fitted with each other by rotating the levers which are engaged to the connector fitting parts. The guiding hood includes locking means configured to be locked and engaged to the board mounted connectors respectively by being elastically engaged with engaging parts of the board mounted connectors respectively in a direction in which the board mounted connectors are arranged.

6 Claims, 7 Drawing Sheets

(56) References Cited

U.S. PATENT DOCUMENTS

| | | | | |
|---|---|---|---|---|
| 7,364,453 | B2 * | 4/2008 | Matsuura et al. | 439/372 |
| 8,968,038 | B2 * | 3/2015 | Kida et al. | 439/752 |
| 2006/0223383 | A1 | 10/2006 | Kobayashi et al. | |
| 2007/0298637 | A1 | 12/2007 | Matsuura et al. | |
| 2008/0020613 | A1 * | 1/2008 | Matsuura et al. | 439/157 |
| 2011/0053405 | A1 | 3/2011 | Kobayashi et al. | |
| 2014/0065849 | A1 | 3/2014 | Kida el al. | |

FOREIGN PATENT DOCUMENTS

| | | | |
|---|---|---|---|
| JP | 2004-319140 | A | 11/2004 |
| JP | 2006-286577 | A | 10/2006 |
| JP | 2008-034336 | A | 2/2008 |
| JP | 2009-259442 | A | 11/2009 |
| JP | 2010-108791 | A | 5/2010 |
| JP | 2014-49330 | A | 3/2014 |
| JP | 102013217122 | A1 | 3/2014 |
| WO | 2010/050151 | A1 | 5/2010 |

OTHER PUBLICATIONS

Communication dated Mar. 30, 2015 issued by the Korean Intellectual Property Office in counterpart Korean Patent Application No. 10-2013-0106061.

Communication issued on Sep. 1, 2015 by the German Patent Office in related Application No. 102013217631.7.

* cited by examiner

CONNECTOR DEVICE

BACKGROUND

The present invention relates to a connector device.

An SMT (Surface Mounting Technology) connector may be mounted to an electronic device such as an ECU. In this kind of SMT connector (board mounted connector), in order to connect a large number of signal electric wires, a multi-electrode connector is often used. In such a multi-electrode connector, with the increase of the force to insert or remove coupled connectors, the operation efficiency may be decreased. In order to eliminate this disadvantage, the inserting/removing force is decreased by a rotating lever by using the principle of leverage (for example, Patent documents 1, 2 and 3).

For example, as shown in FIG. 7, a connector device disclosed in the patent document 1 includes a female housing 501, a male housing 503 which can be fitted with the female housing 501, a casing 505 in which the two housings are accommodated, a slide member 507 which is mounted to the casing 505 movably back and forth, a lever 509 which decreases the force to operate the slide member 507 and assists to fit the two housings, and a moving plate (not shown) installed to the male housing 503. The slide member 507 is disposed near a dashboard side mounting surface 511 of an automobile, and the male housing 503 is fixed to an engine room side mounting surface 513 which is opposed to the dashboard side mounting surface 511. The male housing 503 is installed to the casing 505 in which the female housing 501 is accommodated beforehand. In this state, by pushing the slide member 507 toward the engine room side, the two housings approach in a direction which is roughly perpendicular to the pushing direction so that the two housings are fitted properly.

While a cam part 515 is made to face the entrance of a cam receiving part 517, if the lever 509 pushes the slide member 507 to the casing side, an operating cam part 519 relatively moves along an operating cam receiving part 521, and with the movement, the lever 509 rotates around a support pin. When the lever 509 rotates, the cam part 515 relatively moves along the cam receiving part 517, and the male housing 503 displaces relatively downwards to the casing 505 to be installed properly.

[Patent document 1] JP-A-2006-286577

[Patent document 2] JP-A-2004-319140

[Patent document 3] JP-A-2008-34336

SUMMARY

In the above board mounted connector, when the board mounted connecter is to be fitted, the board mounted connecter is often inserted by fumbling because it cannot be seen in an in-vehicle assembling environment. Further, it is not easy to position, especially when the board mounted connector is a multi-electrode connector. In addition, the reliability of the board mounted connector at the soldered part of the mounted board is lower than that of a DIP (Dual Inline Package) connector. Particularly, in the in-vehicle assembling environment, the external force because of the abutment between the board mounted connector and the mating side connector is applied. Furthermore, if the mating side connector is a lever-type connector, the operating force of the lever 509 is applied to the board mounted connector. Therefore, the traditional board mounted connector becomes a factor which causes decreasing of the reliability of the soldered part.

It is therefore one advantageous aspect of the present invention to provide a connector device so that it is easy to position a mating side connector relative to a board mounted connector, and the reliability of the soldered part in the board mounted connector will not decrease.

According to one advantage of the invention, there is provided a connector device comprising:

a plurality of board mounted connectors, mounted on a board accommodated in a housing case, and arranged at an opening part of the housing case;

mating side connectors, configured to be fitted with the board mounted connectors respectively;

levers, rotatably attached to the mating side connectors; and a guiding hood, including a plurality of connector fitting parts which guide an insertion of the mating side connectors corresponding to the board mounted connectors, and configured to be attached to the opening part of the housing case, wherein the board mounted connectors and the mating side connectors are configured to be fitted with each other by rotating the levers which are engaged to the connector fitting parts, the guiding hood includes locking means configured to be locked and engaged to the board mounted connectors respectively by being elastically engaged with engaging parts of the board mounted connectors respectively in a direction in which the board mounted connectors are arranged.

The connector device may be configured such that: the locking means includes a flexible locking arm extending in a direction in which the mating side connectors are fitted with the board mounted connectors, the engaging part includes a beak part configured to engaged with the distal end of the locking arm, and a gap is formed between an base portion of the locking arm and the engaging part in a state where the locking arm is engaged with the beak part.

DETAILED DESCRIPTION OF EXEMPLIFIED EMBODIMENTS

Below, embodiments of the present invention are described with reference to the figures.

Figure 1:
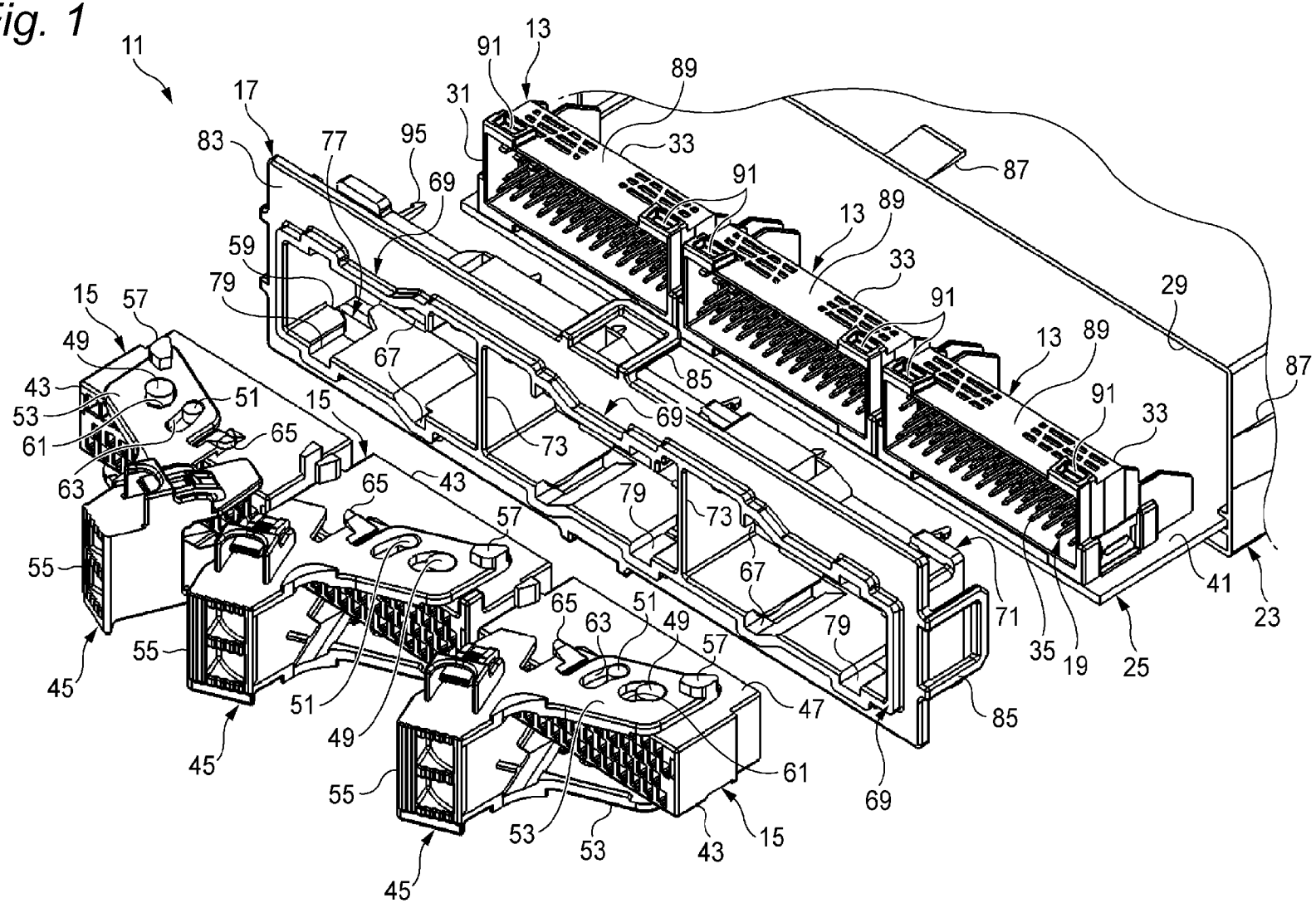
FIG. 1 is an exploded perspective view of a connector device according to one embodiment of the present invention.
Figure 6:
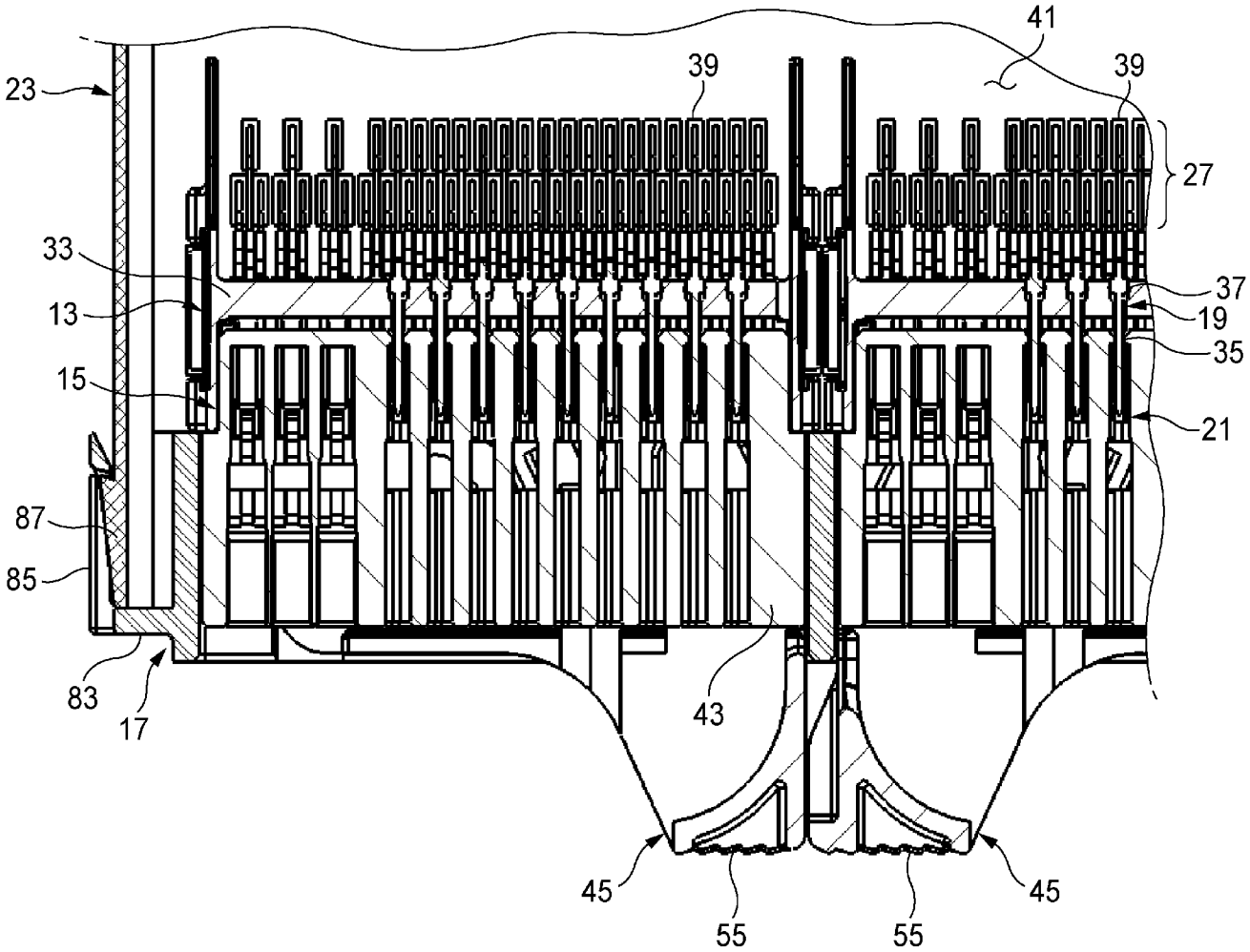
FIG. 6 is a horizontal sectional view of main parts of the connector device, in which the mating side connector is connected to a board mounted connector through the guiding hood shown in FIG. 3.
Figure 7:
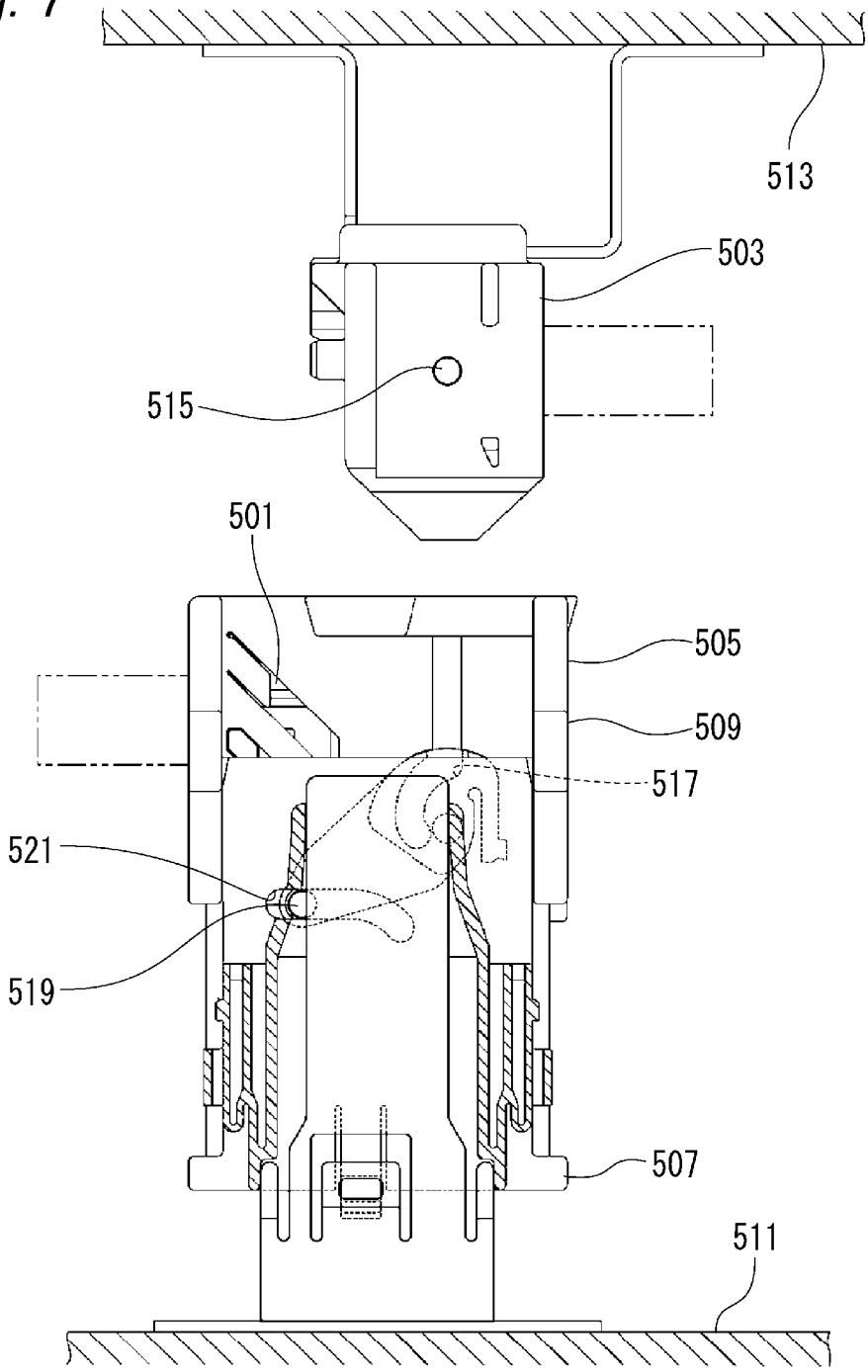
FIG. 7 is a sectional side view of main parts which shows that a slide member is temporarily held to a fixture in a traditional connector device.

As shown in FIG. 1, a connector device 11 of the present embodiment includes a plurality of board mounted connectors 13, a plurality of harness side connectors 15 which are mating side connectors, and a guiding hood 17. The board mounted connector 13 is a so-called SMT connector. In the present embodiment, the board mounted connector 13 is a male connector in which male terminals 19 (refer to FIG. 6) are accommodated, and the harness side connector 15 is a female connector in which female terminals 21 (refer to FIG. 6) are accommodated. In the connector device 11 of the present invention, terminals accommodated in the board mounted connector 13 and the harness side connector 15 may be female/male connectors reverse to those in the present embodiment.

The board mounted connector 13 is surface mounted by soldering a soldered part 27 (refer to FIG. 4) to a board 25 which is accommodated in a housing case 23 having a flat cuboid-shape. Thus, in the connector device 11 according to the present embodiment, it is possible to downsize the mounting structure without using through holes. The housing case 23, for example, may be the outer shell of a device such as an ECU. The housing case 23 is fixed to a vehicle body by fasteners such as bolts and nuts. The board 25 is also fixed to the housing case 23 by fasteners such as screws inside the housing case 23.

The housing case 23 is formed with a flat rectangular opening part 29 (refer to FIG. 1), and a plurality (in the present embodiment, three) of the board mounted connectors 13 are arranged side by side along a longitudinal direction of the opening part 29 so that a coupling opening part 31 which is coupled with the harness side connectors 15 faces towards the front.

In the board mounted connector 13, a plurality of male terminals 19 are press-fitted and fixed on a mounting connector housing 33 which is formed of insulating synthetic resin. Electrical contact parts 35 at the distal end sides of the press-fitted male terminals 19 are arranged side by side at the coupling opening part 31 so that the male terminals 19 contact the female terminals 21. A distal end side and an opposite side thereto of the male terminal 19 which sandwich a press fitted part 37 (refer to FIG. 6) therebetween become board fixed parts 39, and the male terminal 19 is derived from the rear of the mounted connector housing 33. The derived board fixed part 39 is bent along the board 25 after being bent in a direction perpendicular to the board 25, and is fixed to a conductor on a board surface 41 (refer to FIG. 6) by being soldered. That is, the board mounted connector 13 is fixed to the board 25 by the soldered part 27.

According to the board mounted connectors 13, a plurality (in the present embodiment, three) of the harness side connectors 15 are provided respectively. The constructions of the harness side connectors 15 may be identical.

In the present embodiment, among the three identical harness side connectors 15, the left one of FIG. 1 is used by being right-to-left reversed. The harness side connector 15 includes a harness side connector housing 43 formed of insulating synthetic resin, female terminals 21 which are accommodated in the harness side connector housing 43, and an inserting/removing lever 45 which is a lever. The harness side connector housing 43 includes two side surfaces 47 which face each other. The central parts in the longitudinal direction of the two side surfaces 47 are provided with columnar first boss parts 49 and second boss parts 51, which are spaced.

The inserting/removing lever 45 includes a pair of side plates 53 which are formed of insulating synthetic resin, and are arranged in parallel with each other, and one ends of which are spaced and separated from each other, and an operating part 55, which couples the other ends of the pair of side plates 53. The operating part 55 becomes a force point when the inserting/removing lever 45 is rotated. An engaging projection 57 is provided at one end of the side plate 53. The engaging projections 57 are caught into the guiding hood 17 by entering engaging projection accommodating grooves 59 to be described below which the guiding hood 17 is provided with. The engaging projections 57 become fulcrums of the inserting/removing lever 45. In addition, a pair of first boss accommodating holes 61 and a pair of second boss accommodating holes 63, into which the first boss parts 49 and the second boss parts 51 are fitted, are formed at places closer to the other end side than the engaging projections 57. The first boss accommodating holes 61 and the second boss accommodating holes 63 become action points when the inserting/removing lever 45 is rotated.

The side plate 53 of the inserting/removing lever 45 is provided with a sliding claw 65 disposed at opposite to the fitting projection 57 to sandwich the first boss accommodating hole 61 and the second boss accommodating hole 63. The sliding claws 65 enter into guiding grooves 67 to be described below which the guiding hood 17 is provided with.

Figure 2A:
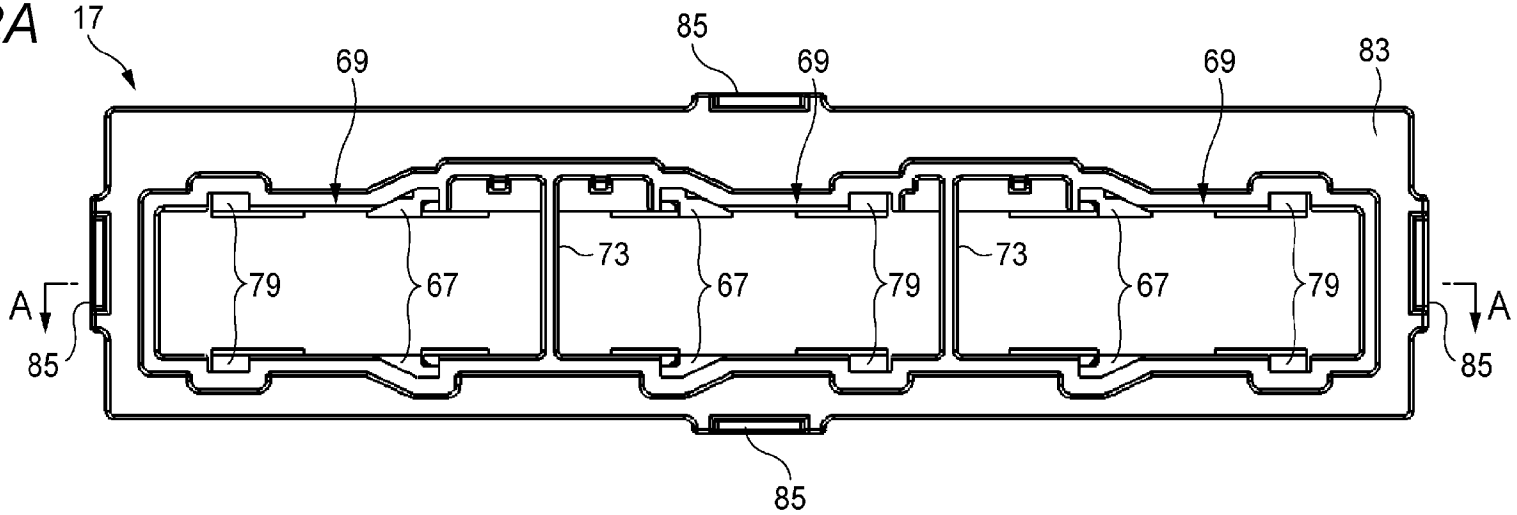
FIG. 2A is a front view of a guiding hood shown in FIG. 1.
Figure 2B:
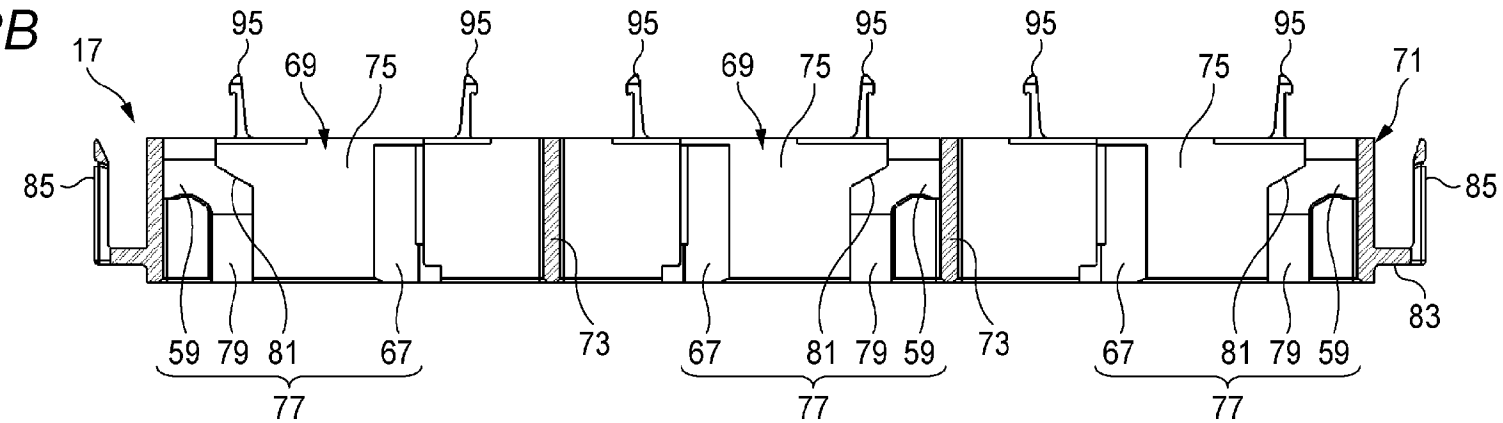
FIG. 2B is an A-A sectional view of FIG. 2A.

The guiding hood 17 includes a plurality of connector fitting parts 69 which guide the insertion of the harness side connectors 15 corresponding to the board mounted connectors 13. That is, in the guiding hood 17, a hood main body 71 (refer to FIG. 2) is formed into a square pipe shape both ends of which are opened. The hood main body 71 is inserted into the opening part 29 of the housing case 23. In the hood main body 71, the connector fitting parts 69, in which the board mounted connectors 13 are accommodated respectively, and which can receive the harness side connectors 15, are partitioned by separating walls 73 to correspond to the board mounted connectors 13 respectively. That is, the guiding hood 17 is so constructed that the slot of the plurality of board mounted connectors 13 is performed with an integrated hood construction.

An operating mechanism part 77 of the inserting/removing lever 45 is provided on each hood inner surface 75 (refer to FIG. 2) of the connector fitting part 69. The operating mechanism part 77 includes an engaging projection guiding groove 79, an engaging projection accommodating groove 59, a taper wall 81 and a guiding groove 67. The engaging projection guiding groove 79 extends to a side of the board mounted connectors 13 with respect to the connector fitting part 69 along a connector fitting direction in which the mating side connectors 15 are fitted with the board mounted connectors 13. The engaging projection accommodating groove 59 is coupled with an end of the engaging projection guiding groove 79, and extends in a direction intersecting with the engaging projection guiding groove 79. The taper wall 81 is formed at a part where the engaging projection guiding groove 79 and the engaging projection accommodating groove 59 are joined, and is inclined relative to the connector fitting direction. The guiding groove 67 is provided roughly parallel to the engaging projection guiding groove 79, and extends to the side of the board mounted connectors 13 with respect to the connector fitting part 69 along the connector fitting direction. In the connector device 11, the board mounted connector 13 and the harness side connector 15 are engaged while the inserting/removing lever 45 of the harness side connector 15 which is engaged in the operating mechanism part 77 of the connector fitting part 69 is rotated.

A flange part 83 (refer to FIG. 2) projecting outwards all around is provided at one end in the square pipe axial direction of the hood main body 71, and the flange part 83 abuts against the fringe of the opening part 29 when the hood main body 71 is inserted into the opening part 29 of the housing case 23. When the harness side connectors 15 are inserted into the connector fitting parts 69, the gap between the harness side connectors 15 and the opening part 29 is blocked by the flange part 83 of the guiding hood 17. That is, the guiding hood 17 also serves as a cover to block the opening part 29 of the housing case 23. Four frame-like locking parts 85 are provided at the centers of four sides of the flange part 83 respectively, and the four frame-like locking parts 85 are locked to wedge-like locks 87 which protrude from the outer peripheral surfaces of the housing case 23. Thereby, the guiding hood 17 is regulated from being detached from the opening part 29, and is installed to the housing case 23.

In the mounting connector housing 33 of the board mounted connector 13, a pair of (left and right) engaging parts 91 are protruded from the top surface 89 (refer to FIGS. 1 and 4) of the top wall of the coupling opening part 31 along the longitudinal direction of the coupling opening part 31. The engaging parts 91 are formed into a square frame-like shape, and beak parts 93 are protruded from corners at the side of the board mounted connectors 13 in the side edges that face each other (refer to FIG. 5).

Figure 4:
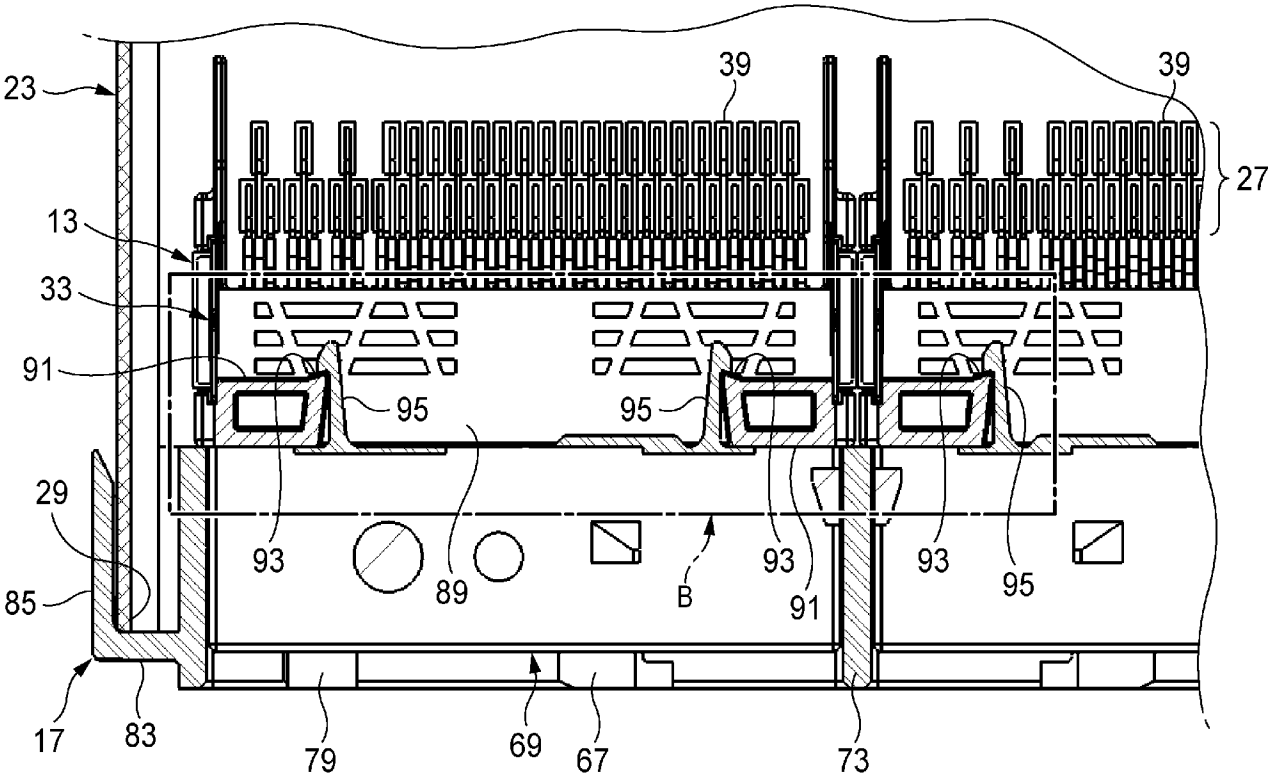
FIG. 4 is a horizontal sectional view of main parts of the housing case in which the guiding hood shown in FIG. 3 is installed.

On the other hand, the guiding hood 17 is provided with locking means which may be locked/engaged to the board mounted connector respectively by being elastically engaged with the engaging parts 91 of the board mounted connectors 13 respectively in the direction the board mounted connectors 13 are arranged. In the present embodiment, the locking means are formed as flexible locking arms 95 extending at the connector fitting direction. That is, a pair of locking arms 95 are disposed at the inner sides of a pair of the engaging parts 91 as shown in FIG. 4, and the lock arms 95 are locked and engaged to the board mounted connectors 13 when the distal ends of the locking arms 95 are locked to the beak parts 93 of the engaging parts 91 respectively from the inner sides of the pair of engaging parts 91.

Figure 5:
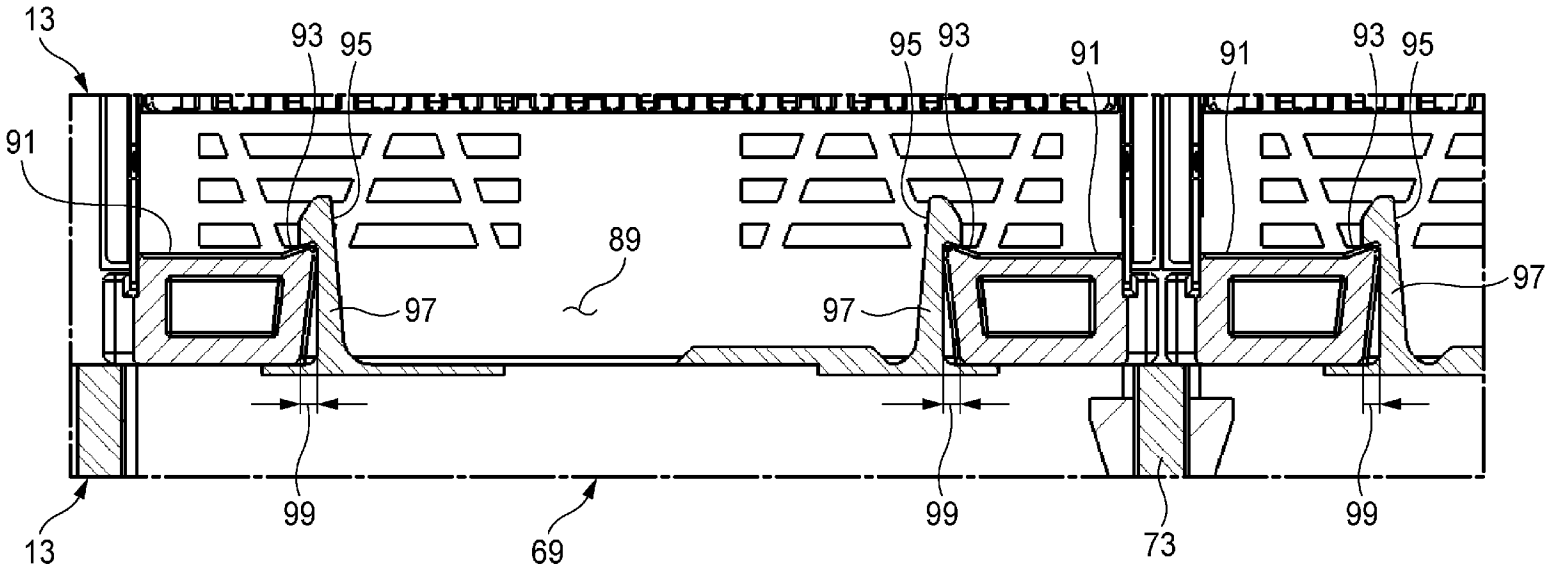
FIG. 5 is an enlarged view of a B part in FIG. 4.

As shown in FIG. 5, while the locking arms 95 extend in a direction parallel to the connector fitting direction, the opposed sides of the engaging parts 91 are inclined to approach mutually towards the beak parts 93. That is, the opposed sides of the pair of engaging parts 91 are inclined to a slanted roof-like shape. Therefore, a gap 99 is formed between an arm base 97 of the locking arm 95 whose distal end is locked to the beak part 93 and the engaging part 91.

Operations of the connector device 11 having the above-mentioned construction will be described below.

Figure 3:
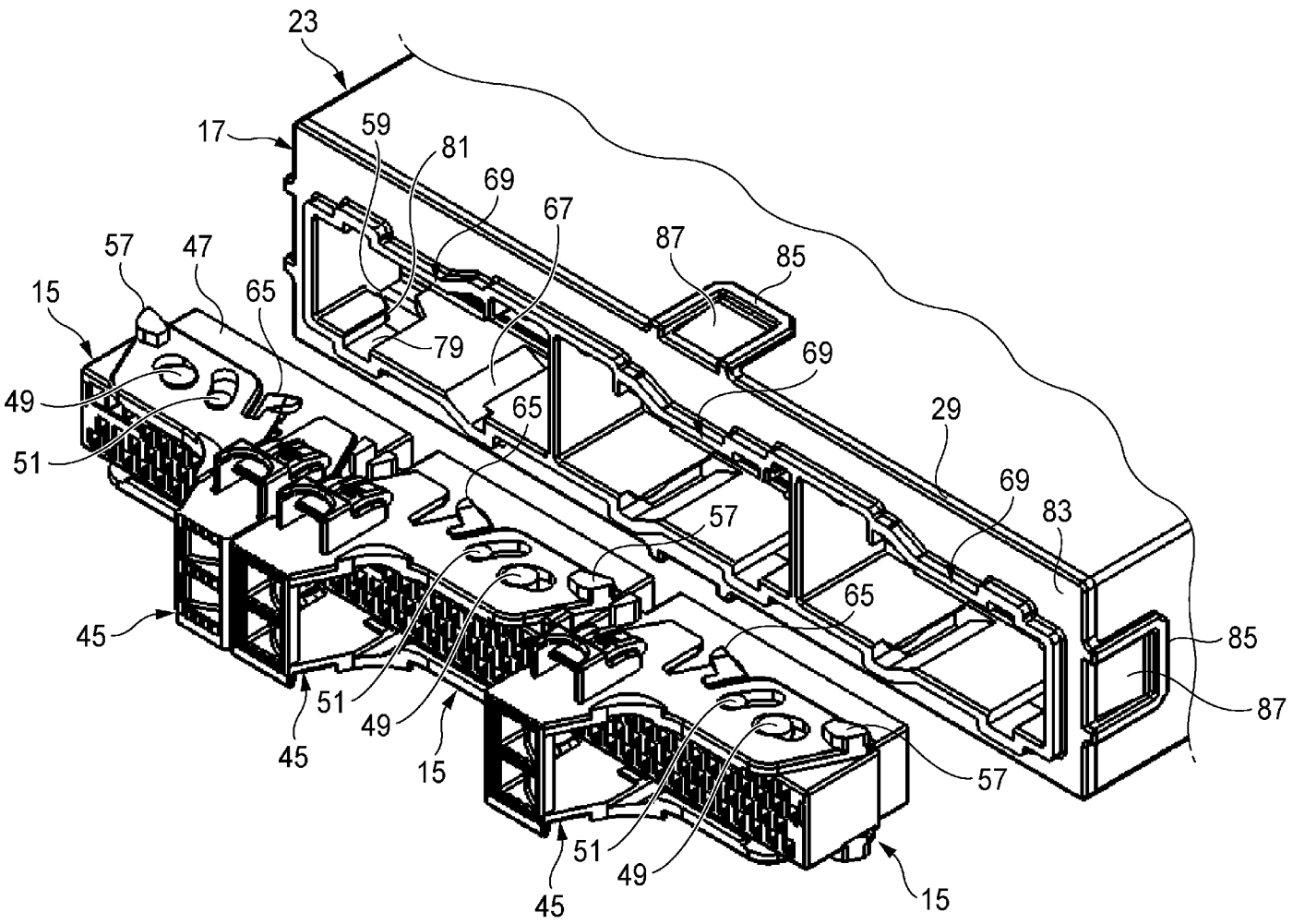
FIG. 3 is a perspective view in which a mating side connector is spaced from the guiding hood which is installed in a housing case shown in FIG. 1.

In the connector device 11 according to the present embodiment, as shown in FIG. 1, the board 25 is accommodated in the housing case 23, and a plurality of the board mounted connectors 13 are mounted side by side on the board 25 which is placed at the opening part 29 of the housing case 23. Thus, a plurality of board mounted connectors 13 line up at the opening part 29 of the housing case 23. As shown in FIG. 3, when the guiding hood 17 is installed to the opening part 29 of the housing case 23, the connector fitting parts 69 of the guiding hood 17 are placed to correspond to the board mounted connectors 13 respectively.

In this case, the locking arms 95 which are the locking means of the guiding hood 17 become lockable to the board mounted connectors 13 respectively by being elastically engaged with the engaging parts 91 of the board mounted connectors 13 respectively in the direction the board mounted connectors 13 are arranged, so as to be engaged with the board mounted connectors 13. Thus, even if the fitting center of the connector fitting part 69 does not correspond to the fitting center of the board mounted connector 13 because of tolerances such as a molding tolerance of the mounting connector housing 33 of the board mounted connector 13, a molding tolerance of the guiding hood 17, or a mounting tolerance of the board mounted connector 13, it is easy to position the guiding hood 17 relative to the board mounted connectors 13 mounted on the board 25.

Furthermore, before the harness side connector 15 and the board mounted connector 13 are engaged with each other, the harness side connector 15 is inserted into the connector fitting part 69 of the guiding hood 17. That is, the harness side connector 15 is finally inserted into the board mounted connector 13 (refer to FIG. 6), but before the harness side connector 15 is inserted directly into the board mounted connector 13, the harness side connector 15 is inserted into the connector fitting part 69 of the guiding hood 17 whose opening part is bigger than the coupling opening part 31 of the board mounted connector 13, and then is guided into the coupling opening part 31 of the board mounted connector 13. Therefore, it is easy to position the harness side connector 15 relative to the board mounted connector 13.

In addition, by rotating the inserting/removing lever 45 which the harness side connector 15 is provided with, the harness side connector 15 is drawn to be engaged with the connector fitting part 69, and the board mounted connector 13 and the harness side connector 15 are coupled by a small insertion force because of the lever effect of the inserting/removing lever 45.

That is, the harness side connector 15 is inserted into the connector fitting part 69 of the guiding hood 17, and the engaging projections 57 of the inserting/removing lever 45 are placed in the engaging projection guiding grooves 79. At this time, the sliding claws 65 of the inserting/removing lever 45 are also placed in the guiding grooves 67 of the connector fitting part 69 at the same time. In this state, the male terminals 19 and the female terminal 21 are not electrically connected. When the inserting/removing lever 45 is rotated, the engaging projections 57 meet the taper walls 81 and are drawn into the engaging projection accommodating grooves 59. Both the first boss accommodating holes 61 and the second boss accommodating holes 63 become action points of the inserting/removing lever 45, and both the first boss parts 49 and the second boss parts 51 are pushed into the inner side in the connector fit direction. Thereby, the female terminals 21 are electrically connected to the male terminals 19, and the harness side connector 15 and the board mounted connector 13 have been coupled.

At this time, an external force produced by drawing is transmitted to the operating mechanism parts 77 of the guiding hood 17 by the engaging projections 57. Therefore, the external force is supported by the housing case 23 through the guiding hood 17, and the external force is not transmitted to the board mounted connector 13. In addition, the external force because of the abutment between the harness side connector 15 and the board mounted connector 13 will not be transmitted to the board mounted connector 13. Thus, there is no fear that the external force is applied to the soldered part 27 of the board mounted connector 13, and that the reliability of the soldered part 27 of the board mounted connector 13 drops.

In the connector device 11 of the present embodiment, the locking arms 95 which the guiding hood 17 is provided with are locked to the engaging parts 91 which the board mounted connector 13 is provided with, respectively. The engaging part 91 and the locking arm 95 are locked when the distal end of the locking arm 95 is locked to the beak part 93 of the engaging part 91. The gap 99 is formed between the arm base 97 of the locking arm 95, whose distal end is locked to the beak part 93 of the engaging part 91, and the engaging part 91. Therefore, the guiding hood 17 becomes further moveable in the direction the board mounted connectors 13 are arranged, by the distance of the gap 99 added to the deflection amount of the distal end of the locking arm 95. Thus, even if the fitting center of the connector fitting part 69 largely deviates from the board mounted connector 13, it is possible to position the guiding hood 17 relative to the board mounted connectors 13 which are mounted on the board 25 since the guiding hood 17 can be moved by the width of the gap 99.

Thus, according to the connector device 11 of the present embodiment, it is easy to position the harness side connector 15 relative to the board mounted connector 13, and the reliability of the soldered part 27 in the board mounted connector 13 will not drop.

According to the connector device, the board is accommodated in the housing case, and a plurality of the board mounted connectors are mounted side by side on the board which is placed at the opening part of the housing case. Thus, a plurality of board mounted connectors line up at the opening part of the housing case. When the guiding hood is installed to the opening part of the housing case, the connector fitting parts of the guiding hood are placed to correspond to the board mounted connectors respectively. In this case, the locking arms of the guiding hood become lockable and engageable to the board mounted connectors respectively by being elastically engaged with the engaging parts of the board mounted connectors respectively in the direction the board mounted connectors are arranged. Thus, even if the connector fitting part does not correspond to the board mounted connector because of a molding tolerance of the housing of the board mounted connector, a molding tolerance of the guiding hood, or a mounting tolerance of the board mounted connector, it is easy to position the guiding hood relative to the board mounted connectors mounted on the board.

Furthermore, before the mating side connector and the board mounted connector are engaged with each other, the mating side connector is inserted into the connector fitting part of the guiding hood. That is, before the mating side connector is directly fitted to the board mounted connector, the mating side connector is inserted into the connector fitting part of the guiding hood whose opening part is bigger than that of the board mounted connector, and is guided to the board mounted connector. Therefore, it is easy to position the mating side connector relative to the board mounted connector.

In addition, by rotating the lever which the mating side connector is provided with, the mating side connector is drawn to be engaged with the connector fitting part, and the board mounted connector and the mating side connector are coupled by a small insertion force because of the lever action of the lever. An external force produced by pulling at this time is supported by the housing case through the guiding hood, and the external force is not transmitted to the board mounted connector, and therefore the reliability of the soldered part of the board mounted connector will not drop.

According to the connector device, the locking arms which the guiding hood is provided with are locked to the engaging parts which the board mounted connector is provided with, respectively. The engaging part and the locking arm are locked when the distal end of the locking arm is locked to the beak part of the engaging part. The gap is formed between the arm base of the locking arm, whose distal end is locked to the beak part of the engaging part, and the engaging part. Therefore, the guiding hood becomes further moveable in the direction the board mounted connectors are arranged, by the distance of the gap added to the deflection amount of the distal end of the locking arm. Thus, even if the fitting center of the connector fitting part largely deviates from the board mounted connector, it is possible to position the guiding hood relative to the board mounted connectors which are mounted on the board since the guiding hood can be moved by the width of the gap.

According to the connector device of the present invention, it is easy to position the mating side connector relative to the board mounted connector, and the reliability of the soldered part in the board mounted connector will not drop.

The present invention is not restricted to the above-described embodiments, and suitable modifications, improvements and the like can be made. Moreover, the materials, shapes, dimensions, numbers, installation places, and the like of the components in the above embodiments are arbitrarily set as far as the invention can be attained, and not particularly restricted.

What is claimed is:

1. A connector device comprising:

a plurality of board mounted connectors, each including a mounting connector housing with a coupling opening part, the plurality of board mounted connectors being mounted on a board accommodated in a housing case, and arranged at an opening part of the housing case;

mating side connectors, configured to be fitted with the board mounted connectors respectively;

levers, rotatably attached to the mating side connectors; and a guiding hood, including a plurality of connector fitting parts which guide an insertion of the mating side connectors corresponding to the board mounted connectors, and configured to be attached to the opening part of the housing case, wherein the board mounted connectors and the mating side connectors are configured to be fitted with each other by rotating the levers which are engaged to the connector fitting parts, the guiding hood includes locking portions configured to be locked and engaged to the board mounted connectors respectively by being elastically engaged with engaging parts of the board mounted connectors respectively in a direction in which the board mounted connectors are arranged, and each of the connector fitting parts has an opening part which is bigger than the coupling opening part of the mounting connector housing.

2. The connector device according to claim 1, wherein the locking portions include a flexible locking arm extending in a direction in which the mating side connectors are fitted with the board mounted connectors, the engaging part includes a beak part configured to engage with a distal end of the flexible locking arm, and a gap is formed between a base portion of the flexible locking arm and the engaging part in a state where the flexible locking arm is engaged with the beak part.

3. The connector device according to claim 1, wherein the locking portions extend in a direction parallel to a connector fitting direction in which the board mounted connectors and the mating side connectors are fitted with each other.

4. The connector device according to claim 1, wherein the locking portions include locking portion pairs, each of the locking portion pairs is configured to be locked and engaged to a respective one of the mating side connectors.

5. The connector device according to claim 1, wherein in response to the locking portions being locked and engaged to the mating side connectors respectively, the guiding hood is movable in the direction in which the board mounted connectors are arranged.

6. The connector device according to claim 5, wherein the guiding hood is movable in the direction in which the board mounted connectors are arranged by an amount that is determined by a relationship between the locking portions and the engaging parts.

* * * * *